US009884746B2

(12) United States Patent
Drouet et al.

(10) Patent No.: US 9,884,746 B2
(45) Date of Patent: Feb. 6, 2018

(54) CONFIGURATION OF OPERATING PANELS OF AN ELEVATOR SYSTEM

(71) Applicant: Inventio AG, Hergiswil (CH)

(72) Inventors: Catherine Drouet, Bulle (CH); Frank Olivier Roussel, Lucerne (CH)

(73) Assignee: INVENTIO AG, Hergiswil (CH)

( * ) Notice: Subject to any disclaimer, the term of this patent is extended or adjusted under 35 U.S.C. 154(b) by 25 days.

(21) Appl. No.: 15/106,348

(22) PCT Filed: Dec. 19, 2014

(86) PCT No.: PCT/EP2014/078622
§ 371 (c)(1),
(2) Date: Jun. 20, 2016

(87) PCT Pub. No.: WO2015/091891
PCT Pub. Date: Jun. 25, 2015

(65) Prior Publication Data

US 2017/0001841 A1 Jan. 5, 2017

(30) Foreign Application Priority Data

Dec. 20, 2013 (EP) ..... 13199198

(51) Int. Cl.
*B66B 13/22* (2006.01)
*B66B 1/34* (2006.01)
(Continued)

(52) U.S. Cl.
CPC ..... *B66B 13/22* (2013.01); *B66B 1/3407* (2013.01); *B66B 1/3423* (2013.01); *B66B 1/461* (2013.01); *B66B 5/0031* (2013.01)

(58) Field of Classification Search
CPC ..... B66B 13/22; B66B 1/3407; B66B 1/3423; B66B 1/461; B66B 5/0031
(Continued)

(56) References Cited

U.S. PATENT DOCUMENTS 6,467,585 B1 10/2002 Gozzo et al.
2013/0118836 A1 5/2013 Rossignol
(Continued)

FOREIGN PATENT DOCUMENTS

CN 1351570 A 5/2002
CN 101058380 A 10/2007
(Continued)

OTHER PUBLICATIONS

Supermagnete, Retreived from the Web Jan. 23, 2017, <http://www.supermagnete.ch/>.

*Primary Examiner* — David Warren
(74) *Attorney, Agent, or Firm* — William J. Clemens; Shumaker, Loop & Kendrick, LLP

(57) ABSTRACT

A method and a device configures a floor allocation of at least two operating panels of an elevator system having an elevator car and an elevator control unit in a building having at least two floors, wherein a respective one of the operating panels and an elevator door are located on each floor of the building, wherein a door contact unit is arranged on the elevator door, wherein the door contact unit is opened with the elevator door open, and wherein the elevator car moves vertically between the at least two floors. According to the method and device, the door contact unit is connected with the operating panel on each floor. The elevator car is moved to each floor and the elevator door is opened. The operating panel detects the open door contact unit and allocates the approached floor to the operating panel depending on the position of the elevator car.

15 Claims, 3 Drawing Sheets

(51) Int. Cl.
*B66B 1/46* (2006.01)
*B66B 5/00* (2006.01)

(58) Field of Classification Search
USPC ..... 187/393
See application file for complete search history.

(56) References Cited

U.S. PATENT DOCUMENTS

| | | | | |
|---|---|---|---|---|
| 2013/0275081 | A1* | 10/2013 | Benosman | B66B 7/06 702/150 |
| 2014/0174861 | A1* | 6/2014 | Sarjanen | B66B 1/2458 187/387 |
| 2015/0096844 | A1* | 4/2015 | Lee | B66B 1/3492 187/394 |
| 2016/0304313 | A1* | 10/2016 | Kinnari | B66B 5/0018 |
| 2017/0001841 | A1* | 1/2017 | Drouet | B66B 1/3407 |
| 2017/0029244 | A1* | 2/2017 | Madarasz | B66B 5/0037 |

FOREIGN PATENT DOCUMENTS

| | | | |
|---|---|---|---|
| DE | 19756564 | A1 | 6/1998 |
| DE | 10230380 | B4 | 4/2013 |
| EP | 1321423 | A1 | 6/2003 |
| EP | 1847499 | A2 | 10/2007 |
| EP | 2142460 | B1 | 1/2010 |
| JP | H04280781 | A | 10/1992 |
| JP | H07285747 | A | 10/1995 |
| JP | 2002234675 | A | 8/2002 |
| KR | 101293034 | B1 | 8/2013 |
| WO | 03024854 | A1 | 5/2003 |
| WO | 03024856 | A1 | 5/2003 |
| WO | 2005000727 | A1 | 1/2005 |

* cited by examiner

CONFIGURATION OF OPERATING PANELS OF AN ELEVATOR SYSTEM

FIELD

The invention relates to a method and device for configuring a floor allocation of at least two operating panels of an elevator system exhibiting an elevator car and an elevator control unit in a building having at least two floors, wherein a respective one of the at least two operating panels and an elevator door are located on each floor of the building, wherein a door contact unit is arranged on the elevator door, wherein the door contact unit is opened with the elevator door open, and wherein the elevator car moves vertically between the at least two floors.

BACKGROUND

In an elevator system, an elevator car in an elevator shaft moves vertically between the floors of a building. The elevator car is here most often joined with a drive by way of a suspension element, for example a rope or strap. The elevator system is controlled by an elevator control unit. In order to make a call entry, each floor has an operating panel, which is connected with an elevator control unit via a communication network. Understood by an operating panel are the panels provided on each floor in the access area to the elevator system, which have at least one switch that can be operated by a user for using the elevator system.

Each floor exhibits an elevator door to the elevator shaft. In order to ensure the safety of people present on the floors, each individual elevator door is locked. It is unlocked when the elevator car is located at the height of the elevator doors. According to legal standard EN81-1, the elevator door must be locked prior to any subsequent movement by the elevator car. In addition to a lock, the elevator door exhibits a door contact unit. When the door contact unit is closed, the elevator car in the elevator shaft can be moved. Each door contact unit is a unit of a safety circuit of the elevator system. In the simplest case, they are electrical contacts connected in series, which are positively driven and directly interrupt the safety circuit, and hence the power supply to the drive, when an elevator door is opened or not completely closed or locked. This ensures that the elevator cannot move if an elevator door is open. Opening an elevator door during a ride also results in an immediate termination of the ride.

EP 132 14 23 A1 describes an electrical safety circuit for an elevator, wherein electrical safety circuit switches, such as door locking switches or door contact units, etc., are electrically connected in series by means of a connecting device.

DE 102 30 380 B4 describes a safety circuit with component junctions in a wireless communication network, wherein each component junction exhibits at least one sensor and a communication device for communicating with a controller.

Known from document EP 163 88 80 A1 is a safety system or safety circuit for an elevator system, which has a control unit along with at least one safety element and a bus as the communication network. The bus or safety bus enables communication between the at least one safety element and the control unit. For example, the safety element can monitor the state of the shaft and car doors. In addition, the at least one safety element consists of a receiver and a transmitter.

Document EP 142 76 62 A1 describes a safety system with safety bus. The safety bus is used to enable a safe and reliable monitoring of the shaft doors of an elevator system.

Document 142 76 60 A1 describes a safety system with safety bus that makes it possible to evaluate the state of car and shaft doors.

For example, the book Bus Systems, Parallel and Serial Bus Systems, Local Networks, by Georg Fäarber, R. Oldenbourg, München Wien publishing house, 1987, ISNB 3-486-20120-4, describes what is to be understood by a bus or bus system.

Within the framework of assembling and installing an elevator system in a building, the elevator car is moved to all stopping positions, i.e., to all floors, during a so-called test run, so as to adjust the stopping positions to the level of the respective floors. In addition, it is necessary to set or configure the operating panels distributed on the individual floors, e.g., panels equipped with destination call buttons or other elevator operating panels, and their communication with a central elevator control unit. The floor on which the operating panels are located is allocated to them in terms of their position. This setting or allocation traditionally takes place with several switches, which must each be manually set by a technician on each floor for each operating panel. Configurations manually performed in this way require a high outlay of time and personnel. Furthermore, such switches represent cost-intensive components.

Document EP 1 847 499 A2 describes a way of setting the floor allocation for a plurality of operating panels of an elevator system. To this end, an elevator car encompasses a transmitter unit. The elevator car moves toward each floor, and the operating panel on the floor is activated. The position data describing the floor are sent by the transmitter unit to the operating panel and/or to a central control unit and stored in a memory unit.

A disadvantage to this method is that the operating panels must temporarily encompass a receiver unit, so that the position data can be sent between the transmitter unit in the elevator car and the operating panel. The receiver unit is again removed after the setting process, which is time intensive and increases installation costs.

SUMMARY

The object of the invention is to propose an improved configuration method for operating panels of an elevator system.

The core of the invention lies in the fact that, on each floor of a building exhibiting at least two floors, the elevator system has a door contact unit and an operating panel that are connected with each other on the floor. On each floor, the elevator system exhibits an elevator door on which the door contact unit is arranged. An elevator car of the elevator system that moves vertically between the floors approaches each floor, and the elevator door is opened. In order to configure a floor allocation, the operating panel on the floor being approached detects that the door contact unit is open due to the open elevator door. The approached floor is allocated to the operating panel as a function of the elevator car position.

The (at least two) operating panels on the individual floors are connected with an elevator control unit of the elevator system by means of a communication network. The communication network can here be wired or wireless.

The door contact unit is a unit of a safety circuit that is connected with the elevator control unit. As a rule, the units of the safety circuit are connected in series, and configured as an electrical safety circuit. This means that the safety circuit is interrupted given an open door contact unit, so that no more current can flow, e.g., shutting down the drive. However, a safety circuit with a bus system or a wired or wireless communication network is also conceivable according to the invention. In such a safety circuit, the elevator control unit is notified about the open door contact unit with a message or signal, and shuts down the drive or elevator system.

The door contact unit is connected with the operating panel by a connecting unit. The connecting unit can here be configured as a separate unit or one that is integrated into the door contact unit. In the case of an electrical safety circuit, it can exhibit at least one resistor. This resistor or some other electrical component can have a high impedance, as specified in the List of the European Standard EN81-1 Annex H from May 2005. If the electrical safety contact is an alternating current safety circuit, the connecting unit exhibits at least one rectifier in addition to the resistor. If the safety circuit or door contact unit and the operating panel do not use the same ground, the connecting unit exhibits a galvanic separation. If the door contact unit is a unit of a safety circuit with a bus system, the connecting unit can exhibit at least one communication module for wired or wireless communication between the door contact unit and operating panel.

The operating panel is preferably connected with the safety circuit parallel to the door contact unit.

If the operating panel detects that the connected door contact unit is open, the operating panel can notify the elevator control unit (via the communication network) by way of at least one message. Depending on the at least one transmitted message and depending on the vertical position of the elevator car (in a shaft of the elevator system), the elevator control unit can then allocate the floor to the operating panel transmitting the at least one message. The allocation is transmitted to the operating panel in question. The at least one message can here be as desired. For example, it can be configured as an analog or digital signal, a signaling message, a text message, etc.

The floor can also be allocated by transmitting the vertical position of the elevator car to the operating panel, for example from the elevator control unit, which is located on the floor being approached by the elevator car, and the latter ascertains or determines the allocation of the floor as a function of the detected open door contact unit.

Any methods desired can be used for determining the vertical position of the elevator car (in the shaft). For example, this can be done with sensor units located in the elevator shaft or on the elevator car. The position of the elevator car can be determined by means of the elevator control unit or a control unit on the elevator car or a combination of the options mentioned. The control unit can be a unit of the sensor unit or a separate unit. The determined position can be transmitted either to the elevator control unit or to the operating panel on the floor where the elevator car is located.

The floor allocation is stored by the operating panel in a memory unit. The memory unit can here be integrated into the operating panel or into the elevator control unit.

One advantage of the invention lies in the fact that the allocation of operating panels to the floors of a building can be easily automated. As a result, the installation times and costs can be lowered.

Another advantage lies in the fact that using an electrical safety circuit in the elevator system enables a cost-effective configuration for the cabling between the door contact unit and operating panel by way of the connecting unit. Electrical lines that need not satisfy any special safety requirements are sufficient.

DESCRIPTION OF THE DRAWINGS

The invention will be explained in more detail based on an exemplary embodiment depicted on the figures. Shown on.

DETAILED DESCRIPTION

Figure 1:
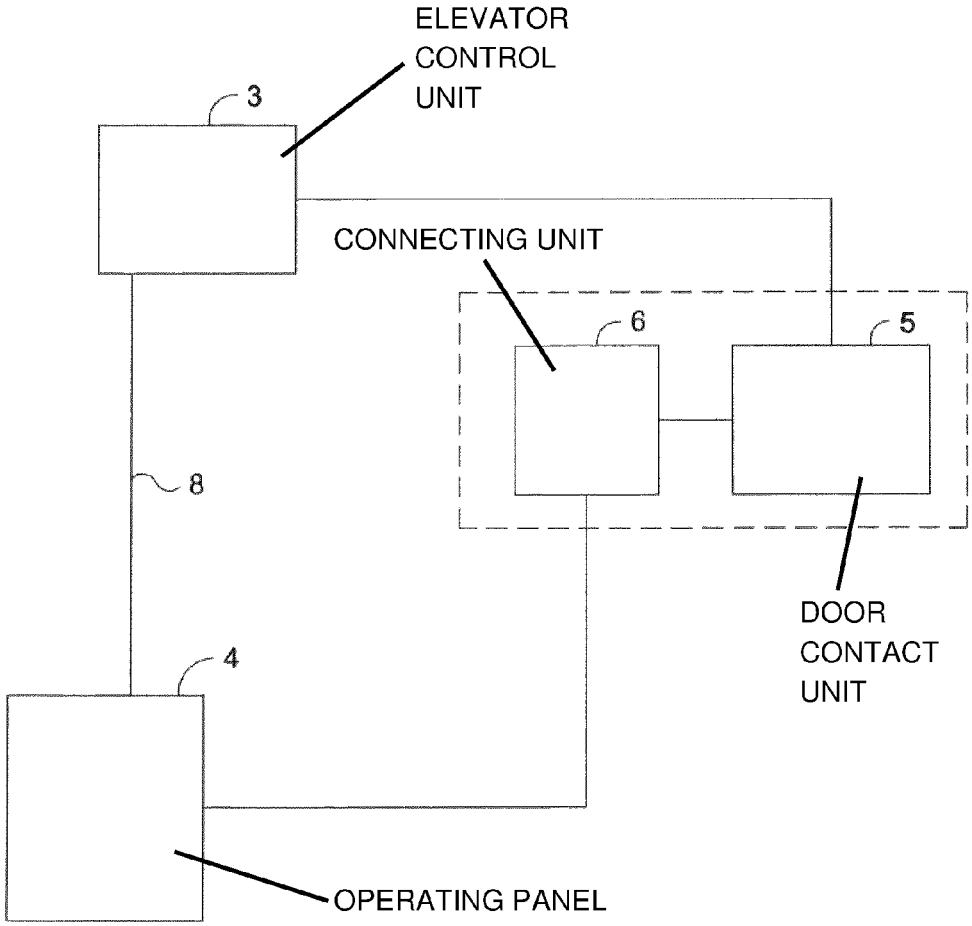
FIG. 1 is a simplified view of elevator components for implementing the method according to the invention.

FIG. 1 presents a simplified view of elevator components for implementing the method according to the invention. An elevator system exhibits an elevator control unit 3, which is connected with an operating panel 4 by means of a communication network 8.

An operating panel 4 is usually arranged on each floor of a building. The operating panel 4 allows a passenger on the elevator system to transmit an elevator trip call to the elevator control unit 3. To this end, the operating panel 4 exhibits at least one switch, pushbutton, touch-sensitive screen (touchscreen display), etc.

The communication network 8 can be configured as desired. For example, it can be wired or wireless. A (serial) bus system, a wireless network (WLAN=wireless local area network), a Bluetooth network, etc., could be used, for example.

In order to satisfy the safety requirements in elevator construction, an elevator system exhibits a safety circuit or monitoring device. The safety circuit typically consists of safety elements connected in series, such as a door contact unit 5, a manual emergency stop switch, a shaft limit switch, a buffer switch, etc. The door contact unit 5 monitors the state of elevator doors. Such a door contact unit 5 is here located on each elevator door on each floor of the building. The safety circuit can be configured as an electrical or electromechanical safety circuit, or as a bus-based safety circuit.

The door contact unit 5 can be configured as a mechanical or electromechanical switching unit, magnetic switching unit, contactless switching unit, RFID switching unit (radio frequency identification=identification of electromagnetic waves), etc.

When the elevator door opens, the door contact unit 5 is opened or interrupted. If the case involves an electrical safety circuit, the circuit is here interrupted, which is detected by the elevator control unit. The elevator control unit 3 then shuts down the elevator system. When using a safety circuit with a bus system, the door contact unit 5 reports or messages the state, for example "opened" to the elevator control unit 3, and the elevator system is shut down based on the report or message. This report or message can consist of an analog or digital signal. However, it can also be a text message, signaling message or some other message.

According to the invention, the door contact unit 5 is connected with the operating panel 4 by means of a connecting unit 6. The connecting unit 6 can here be integrated into the door contact unit 5, which is to be symbolized with the dashed rectangle, or be a separate unit.

When using an electrical safety circuit, the connecting unit 6 encompasses at least one resistor, preferably a high-impedance resistor. When using an alternating current safety circuit, at least one rectifier is additionally provided for the connecting element 6. If the operating panel 4 and door contact unit 5 do not share the same ground, the connecting unit 6 encompasses at least one galvanic separation or separating unit.

Given an electrical safety circuit, the operating panel 4 is connected with the door contact unit 5 by means of an electrical line via the connecting unit 6, or with the safety circuit parallel to the door contact unit 5.

When using a bus-based safety circuit, the connecting unit 6 exhibits at least one communication module. Communication between the operating panel 4 and door contact unit 5 can here be wired or wireless. The operating panel 4 and door contact unit 5 can also be serially connected with each other via the connecting unit 6.

Figure 2:
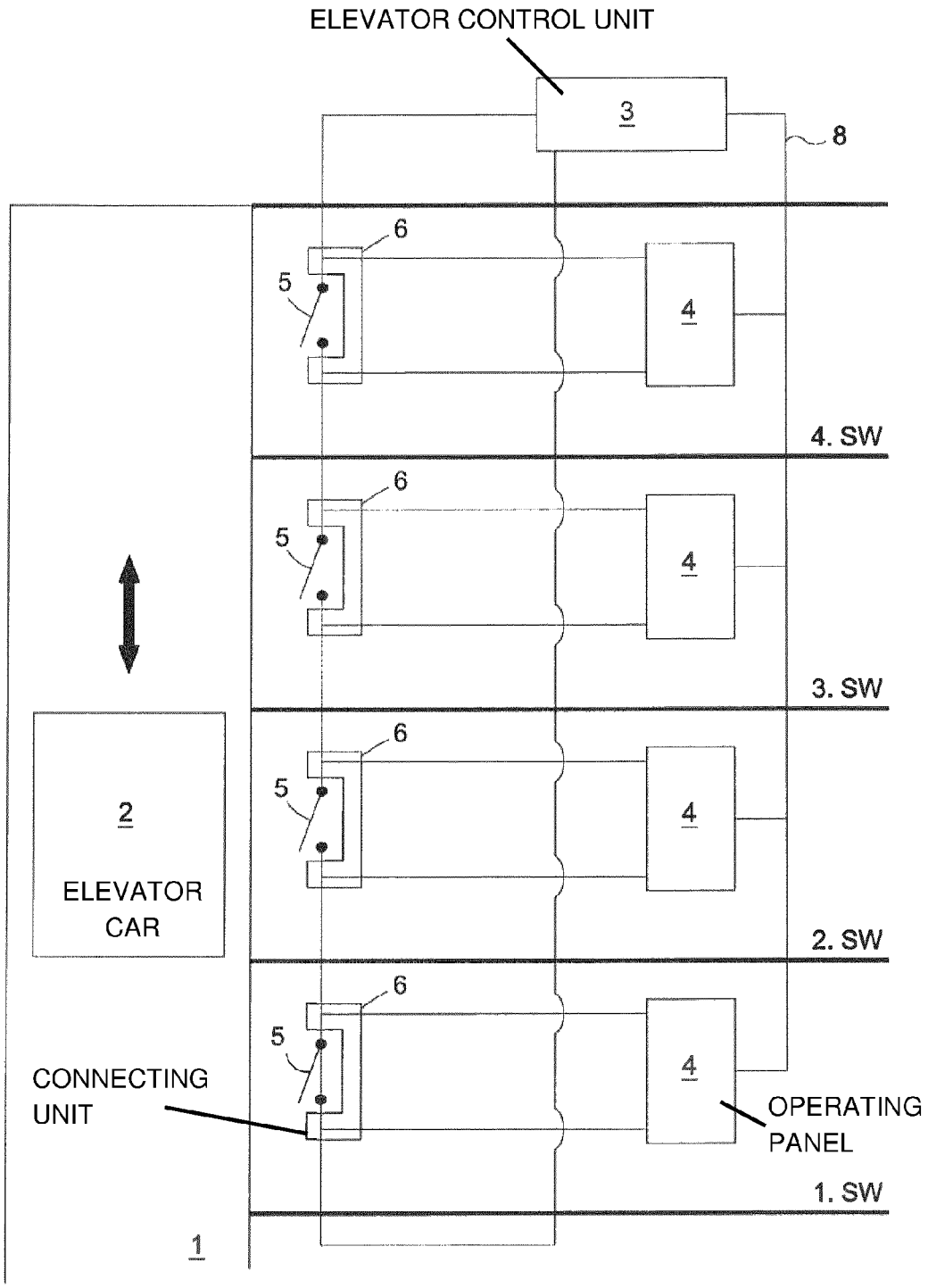
FIG. 2 is a simplified view of an elevator system.

FIG. 2 presents a simplified view of an elevator system with the elevator components described on FIG. 1. In this example, the elevator system is located in a multistory building (1st floor to 4th floor—1.SW, 2.SW, 3.SW, 4.SW respectively), and exhibits an elevator shaft 1. In this elevator shaft 1, an elevator car 2 is moved back and forth between the 1st and 4th floors by means of a drive (not shown).

The elevator system further exhibits an operating panel 4 on each of the 1st to 4th floors, which is connected with an elevator control unit 3 via a wired or wireless communication network 8.

Each of the 1st to 4th floors exhibits an elevator door (not shown) to the elevator shaft 1. As already described on FIG. 1, a door contact unit 5 is situated on this elevator door. The door contact unit 5 in this example is a serially connected safety element of an electrical safety circuit. If the elevator door is opened, the door contact unit 5 also opens, and the circuit of the safety circuit is interrupted. Interrupting the safety circuit causes the elevator system to be shut down.

The operating panel 4 is connected with the door contact unit 5 by a connecting unit 6. The connecting unit 6 can be configured as a separate unit or as a unit of the door contact unit 5. As in this example, the operating panel 4 can be connected with the safety circuit parallel to the door contact unit. The connection between the operating panel 4 and door contact unit 5 can be realized with cost-effective lines, for example cables consisting of copper wires, since there exist no special safety requirements for this connection.

In an electrical safety circuit, the connecting unit 6 exhibits at least one resistor, which preferably is configured to be high impedance. When using an alternating current safety circuit in the elevator system, the connecting unit 6 additionally encompasses a rectifier. If the operating panel 4 and door contact unit 5 or safety circuit do not have the same ground, a galvanic separation is used in the connecting unit 6. In this example, the connecting unit 6 is to have one resistor per line or connecting cable between the door contact unit 5 and operating panel 4.

At the beginning of the configuration process, the elevator car 2 is moved (by the elevator control unit 3) to one of the 1st to 4th floors. Any of the 1st to 4th floors can be approached first in the method according to the invention. The bottom or top of the four floors is preferably the starting point, after which the other floors are approached in one direction until the top or bottom floor has been reached.

Once the elevator car 2 arrives at one of the 1st to 4th floors, the elevator door opens. This also causes the door contact unit 5 to open, and the safety circuit is interrupted.

The operating panel 4 on the approached floor detects the open door contact unit 5. The operating panel 4 is now allocated to the approached 1st to 4th floor by having the elevator control unit 3 notify the operating panel 4 on the approached 1st to 4th floor about the position of the elevator car 2, and the operating panel 4 allocate itself to the approached 1st to 4th floor. Or the operating panel 4 reports or signals the open door contact unit 5 to the elevator control unit 3, the elevator control unit 3 allocates the approached 1st to 4th floor to the operating panel 4 depending on the position of the elevator car 2, and sends the allocation to the operating panel 4 by way of a message or signal. Also conceivable is for the elevator control unit 3 to store the allocation of the operating panel 4 only in a memory unit of the elevator control unit 3, i.e., not send this allocation to the operating panel 4. In addition to the allocation, an identification feature for the operating panel 4 must then be stored, which allows the elevator control unit 3 to identify the respective operating panel 4 given a call request from the operating panel 4. For example, the identification feature can be an address, serial number or some other clear or one-to-one feature.

In general, the allocation is stored in a memory unit of the operating panel 4 or elevator control unit 3.

The message, signal or report can be as desired. For example, use can be made of an analog or digital signal, a text message, a signaling message (of a wired or wireless communication network), etc.

Figure 3:
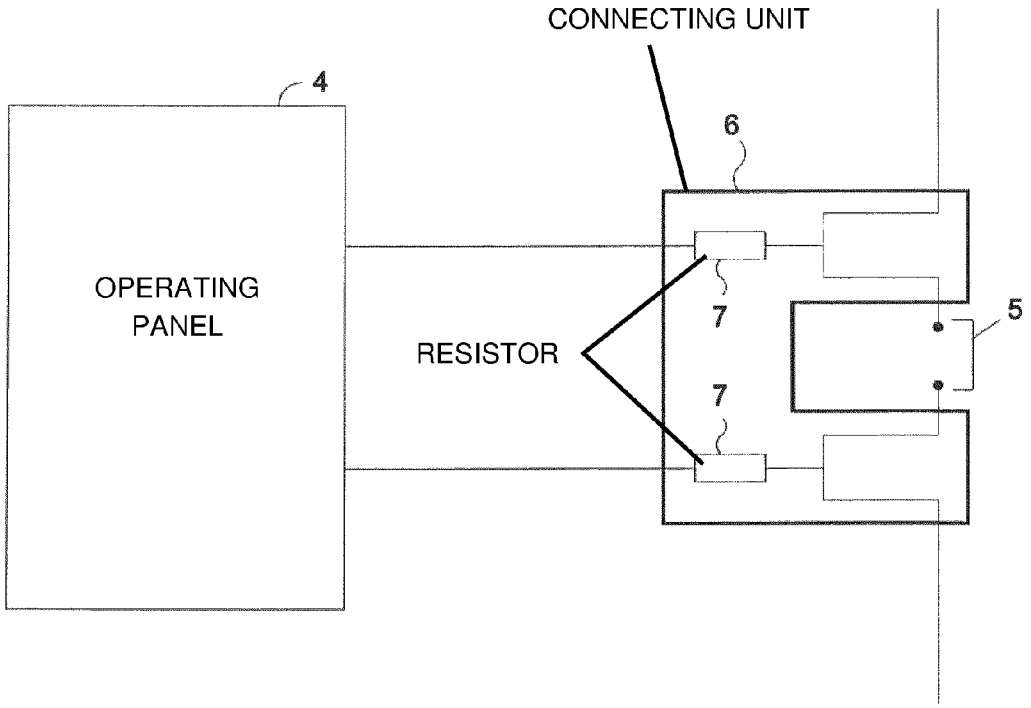
FIG. 3 is an exemplary connecting unit for an electrical safety circuit.

FIG. 3 shows an exemplary connecting unit 6 for an electrical safety circuit. As already described on FIGS. 1 and 2, an operating panel 4 is connected with a door contact unit 5 by a connecting unit 6. In this example, the connection consists of two lines, e.g., configured as copper wire cables. The connecting unit 6 encompasses a resistor 7 for each line. The two resistors 7 are preferably configured to be high impedance.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for configuring a floor allocation of at least two operating panels of an elevator system including an elevator car and an elevator control unit in a building having at least two floors, wherein a respective one of the operating panels and a respective elevator door are located on each of the floors of the building, wherein a respective door contact unit is arranged on each of the elevator doors and is opened when the associated elevator door is open, and wherein the elevator car moves vertically between the at least two floors, comprising the steps of:

a. connecting each of the door contact units with the operating panel on the floor where the associated elevator door is located;

b. moving the elevator car to one of the floors and opening the associated elevator door;

c. detecting with the operating panel located at the one floor the open door contact unit arranged at the one floor;

d. allocating the one floor to the operating panel located at the one floor; and e. performing steps b through d for each of the floors.

2. The method according to claim 1 wherein each of the operating panels is connected to the respective door contact unit by a respective connecting unit.

3. The method according to claim 2 wherein the connecting unit is a separate unit or is integrated into the respective door contact unit.

4. The method according to claim 1 wherein the door contact units are connected with the elevator control unit by a safety circuit.

5. The method according to claim 4 wherein the safety circuit is an electrical safety circuit or a safety circuit with a bus system.

6. The method according to claim 4 wherein the operating panels are connected with the safety circuit in parallel to the door contact units.

7. The method according to claim 1 wherein the operating panels are connected with the elevator control unit via a communication network.

8. The method according to claim 7 wherein the communication network is a wired communication network or a wireless communication network.

9. The method according to claim 1 wherein the operating panels send at least one message relating to the detected open door contact unit to the elevator control unit.

10. The method according to claim 9 wherein depending on the at least one message and depending on a vertical position of the elevator car, the elevator control unit allocates the floor at which the elevator car is positioned to the operating panel sending the at least one message and transmits the allocation to the operating panel sending the at least one message.

11. The method according to claim 1 wherein a vertical position of the elevator car is sent to the operating panel located on the floor being approached by the elevator car, and allocation of the floor being approached is determined by the operating panel located at the floor being approached depending on the detection of the respective door contact unit being open.

12. The method according to claim 1 wherein the operating panels store the floor allocation in a memory unit.

13. A device for configuring a floor allocation of at least two operating panels of an elevator system including an elevator car and an elevator control unit in a building having at least two floors, wherein a respective one of the operating panels and a respective elevator door are located on each of the floors of the building, wherein a respective door contact unit is arranged on each of the elevator doors and is opened when the associated elevator door open, and wherein the elevator car moves vertically between the at least two floors, comprising: a respective connecting unit on each of the floors connecting the respective door contact unit with the respective operating panel.

14. The device according to claim 13 wherein the connecting units include at least one resistor or a communication module.

15. The device according to claim 13 wherein the connecting units include at least one of a rectifier and a galvanic separation.

* * * * *